US008128516B2

(12) United States Patent
Pan et al.

(10) Patent No.: US 8,128,516 B2
(45) Date of Patent: Mar. 6, 2012

(54) BALL GAME TRAINING APPARATUS

(75) Inventors: Francis Chung Hwa Pan, Taichung (TW); Chin-Chieh Chu, Taichung County (TW); Fu-Chin Chuang, Changhua County (TW)

(73) Assignee: Francis Chung Hwa Pan, Taichung (TW)

( * ) Notice: Subject to any disclaimer, the term of this patent is extended or adjusted under 35 U.S.C. 154(b) by 0 days.

(21) Appl. No.: 12/782,292

(22) Filed: May 18, 2010

(65) Prior Publication Data

US 2011/0287871 A1 Nov. 24, 2011

(51) Int. Cl.
*A63B 69/00* (2006.01)

(52) U.S. Cl. ..... 473/427; 473/422

(58) Field of Classification Search ..... 473/422, 473/429, 423, 427
See application file for complete search history.

(56) References Cited

U.S. PATENT DOCUMENTS 2,633,320 A * 3/1953 Salmi ..... 473/429
(Continued)

*Primary Examiner* — Mitra Aryanpour
(74) *Attorney, Agent, or Firm* — Muncy, Geissler, Olds & Lowe, PLLC

(57) ABSTRACT

A ball game training apparatus includes a positioning device, a first pivot device connected to the positioning device and turnable relative to the positioning device in X-axis direction, a second pivot device connected to the first pivot device and turnable relative to the first pivot device in Y-axis direction, and a driven device connected to the second pivot device and turnable relative to the second pivot device and having a force-receiving ball disposed remote from the second pivot device and strikable to move by an external force.

9 Claims, 3 Drawing Sheets

U.S. PATENT DOCUMENTS

| | | | | | |
|---|---|---|---|---|---|
| 3,408,070 | A | * | 10/1968 | Gonzales et al. | 473/427 |
| 3,547,437 | A | * | 12/1970 | Andersen | 473/427 |
| 3,588,104 | A | * | 6/1971 | Griffin | 473/424 |
| 4,042,237 | A | * | 8/1977 | Moraru | 473/429 |
| 4,175,744 | A | * | 11/1979 | Llewellyn | 473/149 |
| 4,561,661 | A | * | 12/1985 | Walker et al. | 473/423 |
| 4,616,834 | A | * | 10/1986 | Davis | 473/429 |
| 5,228,683 | A | * | 7/1993 | Beimel | 473/427 |
| 5,275,396 | A | * | 1/1994 | Sudia | 473/427 |
| 5,494,278 | A | * | 2/1996 | Linden | 473/427 |
| 5,553,848 | A | * | 9/1996 | Amron | 473/416 |
| 5,605,326 | A | * | 2/1997 | Spear, Jr. | 473/422 |
| 5,711,724 | A | * | 1/1998 | McGovern | 473/427 |
| 5,795,251 | A | * | 8/1998 | Andersen | 473/427 |
| 5,836,836 | A | * | 11/1998 | Grimes | 473/427 |
| 7,517,291 | B2 | * | 4/2009 | Waldron | 473/427 |
| 7,811,183 | B1 | * | 10/2010 | Ohle | 473/429 |
| 2009/0286630 | A1 | * | 11/2009 | Aguirre | 473/420 |

* cited by examiner

BALL GAME TRAINING APPARATUS

BACKGROUND OF THE INVENTION

1. Field of the Invention

The present invention relates to sports training apparatus and more particularly, to a ball game training apparatus capable of providing multidimensional motion data for reference in training.

2. Description of the Related Art

There is known a ball game training apparatus, which comprises an upright shaft, and a ball linked to the upright shaft and strikable to turn about the upright shaft. This apparatus cannot simulate the movement of a free ball upon a force. Further, this ball game training apparatus is not practical for three-dimensional ball-game training. It has no sensor means to detect a three-dimensional motion of the ball for three-dimensional analysis. Thus, the direction and amount of movement of the ball simulated by this ball game training apparatus are not highly reliable. Therefore, an improvement in this regard is necessary.

SUMMARY OF THE INVENTION

The present invention has been accomplished under the circumstances in view. It is the main object of the present invention to provide a ball game training apparatus, which produces a thee-dimensional data indicative of the direction and amount of movement of the force-receiving ball of its driven device for training reference when its driven device is driven by a player and, which is highly detachable and durable in use, assuring high reliability and sensitivity.

To achieve this and other objects of the present invention, a ball game training apparatus comprises a positioning device, a first pivot device connected to the positioning device and turnable relative to the positioning device in X-axis direction, a second pivot device connected to the first pivot device and turnable relative to the first pivot device in Y-axis direction, and a driven device connected to the second pivot device and turnable relative to the second pivot device and having a force-receiving ball disposed remote from the second pivot device and strikable to move by an external force.

DETAILED DESCRIPTION OF THE INVENTION

Figure 1:
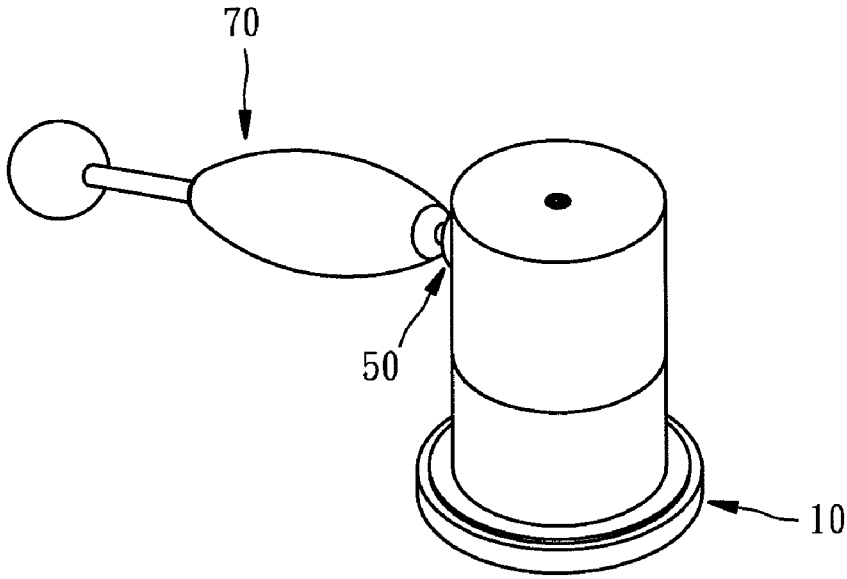
FIG. 1 is an elevational view of a ball game training apparatus in accordance with the present invention.
Figure 2:
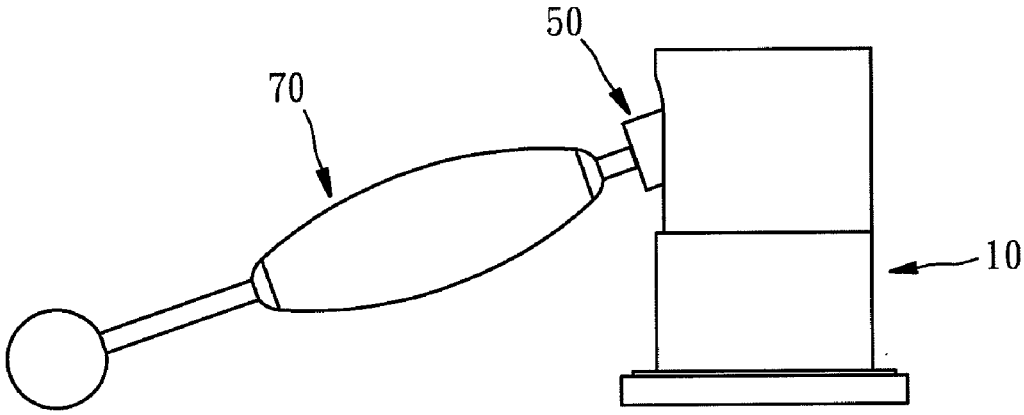
FIG. 2 is a front view of the ball game training apparatus in accordance with the present invention.
Figure 3:
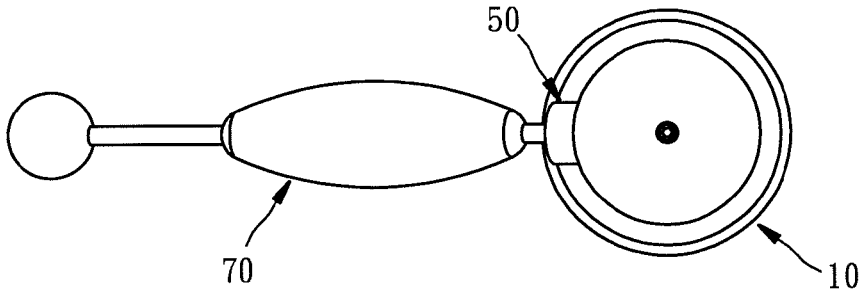
FIG. 3 is a top view of the ball game training apparatus in accordance with the present invention.

Referring to FIGS. 1~5, a ball game training apparatus in accordance with the present invention is shown comprising:

a positioning device 10, which comprises a base member 11, a casing 12 arranged on the base member 11 and a top cover 13 mounted on and rotatable relative to the casing 12;

a light gate 20 mounted in the positioning device 10;

a first pivot device 30, which comprises a vertical shaft 31 rotatably pivoted to the positioning device 10;

an encoder wheel 40 mounted on the first pivot device 30 and rotatable with the first pivot device 30 relative to the light gate 20 to induce signals;

a second pivot device 50, which comprises a first connection portion 51 pivotally connected to the first pivot device 30 and a second connection portion 52 pivotally coupled to the first connection portion 51; and a driven device 70, which has a connection member 71 disposed at its one end and pivotally coupled to the second pivot device 50 and a force-receiving ball 90 disposed at its other end remote from the second pivot device 50 for receiving a external force to cause a three-dimensional motion relative to the positioning device 10.

In the aforesaid arrangement, the first pivot device 30 is movable relative to the base member 11 of the positioning device 10 in X-axis direction, the second pivot device 50 is movable relative to the first pivot device 30 in Y-axis direction, and the driven device 70 is movable relative to the second pivot device 50 in Z-axis direction. Therefore, the driven device 70 can be driven by an external force to make a three-dimensional motion relative to the positioning device 10.

Further, sensor means (not shown) can be mounted in the force-receiving ball 90 of the driven device 70 to sense the speed and torque of the three-dimensional motion of the driven device 70.

The driven device 70 further comprises a transmission member 80 connected between the connection member 71 and the force-receiving ball 90. The transmission member 80 has mounted therein a wireless transmitter and receiver circuit assembly for receiving detected signals from the sensor means in the force-receiving ball 90 and transmitting received signals to a remote data processing module (not shown). Further, the transmission member 80 of the driven device 70 is not rotatable relative to the force-receiving ball 90.

The remote data processing module is adapted for receiving and processing the data signal produced by the sensor means in the force-receiving ball 90 and received from the wireless transmitter and receiver circuit assembly of the transmission member 80 each time the force-receiving ball 90 is hit by a player. Based on the data obtained from the sensor means in the force-receiving ball 90 through the wireless transmitter and receiver circuit assembly of the transmission member 80, the remote data processing module estimates a simulation of the flying or rolling direction and distance simulated of the force-receiving ball 90.

Figure 4:
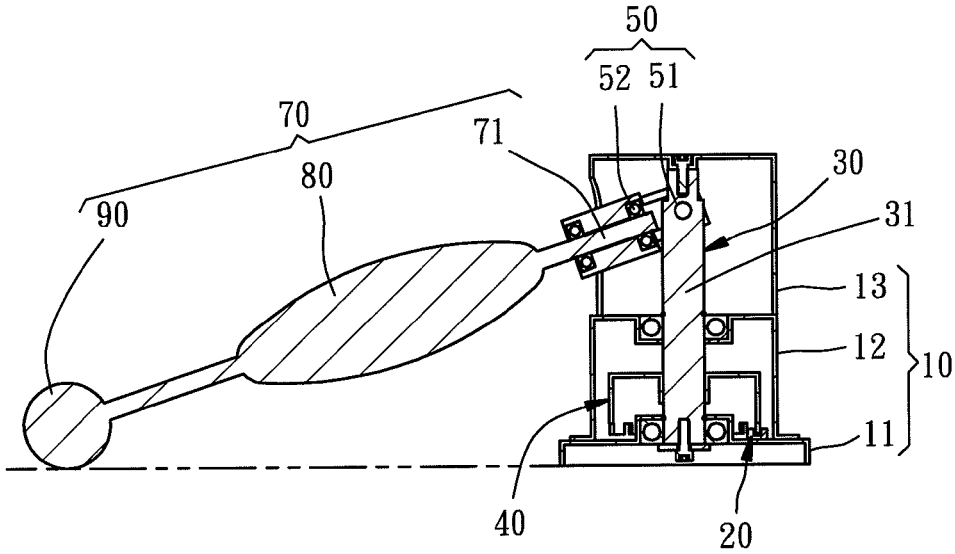
FIG. 4 is a sectional view of the ball game training apparatus in accordance with the present invention.

The operation of the present invention is explained hereinafter with reference to FIG. 4. Subject to the effect of the gravity of the driven device 70, the second pivot device 50 is turned downwards to a predetermined position at a platform (not shown) so that a player can hit the force-receiving ball 90 of the driven device 70.

Figure 5:
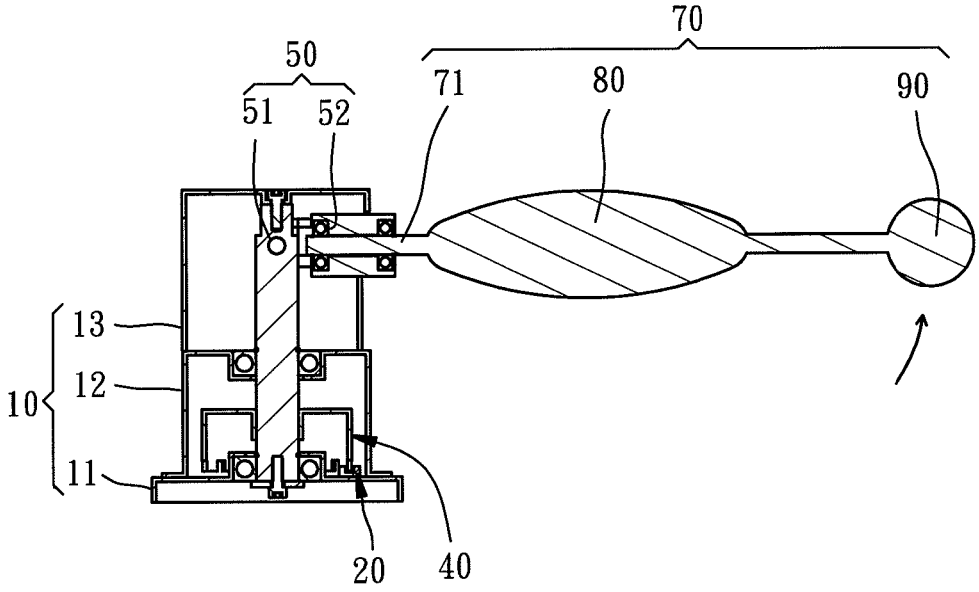
FIG. 5 is a schematic sectional view of the present invention, showing the driven device moved relative to the positioning device.

When the force-receiving ball 90 of the driven device 70 is hit by the player, it is forced to move in Z-axis direction relative to the second pivot device 50 and simultaneously to cause the second pivot device 50 to move in Y-axis direction relative to the first pivot device 30. During movement of the second pivot device 50 relative to the first pivot device 30, the second pivot device 50 also forces the first pivot device 30 to move in X-axis direction relative to the base member 11 of the positioning device 10. Subject to the direction and amount of force applied by the player to the force-receiving ball 90 of the driven device 70 is moved to a transient position, as shown in FIG. 5.

Figure 6:
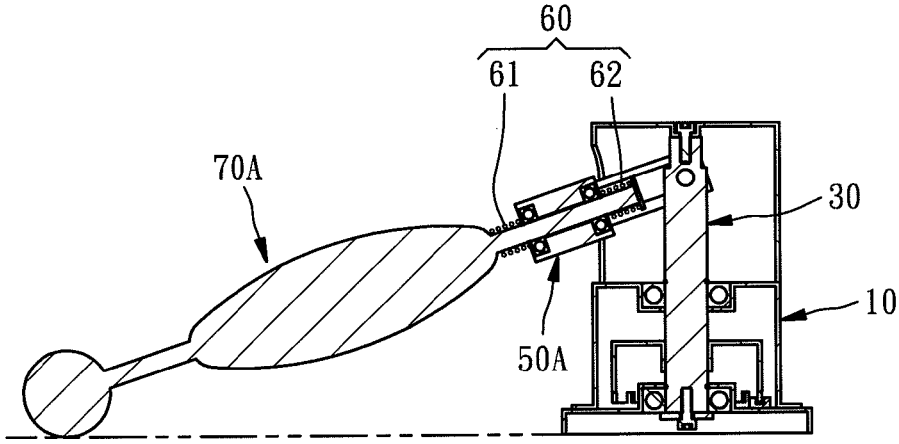
FIG. 6 is a sectional assembly view of an alternate form of the ball game training apparatus in accordance with the present invention.

The ball game training apparatus may be variously embodied. FIG. 6 illustrates an alternate form of the present invention. According to this alternate form, the ball game training apparatus further comprises a spring unit 60, which comprises a first spring member 61 and a second spring member 62 respectively fastened to the driven device 70A and axially stopped at two opposite sides of the second pivot device 50A to buffer axial movement of the driven device 70A relative to the second pivot device 50A.

Further, the first connection portion 51 of the second pivot device 50 can also be connected to the first pivot device 30 in such a manner that the second pivot device 50 can be turned about the axis passing through the connection point between the second pivot device 50 and the first pivot device 30 and can also be moved axially relative to the first pivot device 30, allowing movement of the force-receiving ball 90 relative to the positioning device 10 in X, Y and Z directions.

Alternatively, the first pivot device 30 can be coupled to the positioning device 10 in such a manner that the first pivot device 30 can be turned about the axis passing through the connection point between the first pivot device 30 and the positioning device 10 and can also be moved axially relative to the positioning device 10, allowing movement of the force-receiving ball 90 relative to the positioning device 10 in X, Y and Z directions.

Further, the positioning device 10 can be made having an upright shaft (not shown), and the first pivot device 30 can be sleeved onto the upright shaft of the positioning device 10 in such a manner that the first pivot device 30 can be rotated and moved axially relative to the upright shaft of the positioning device 10.

The invention is not limited to the aforesaid alternative arrangements. For example, the aforesaid light gate 20 and encoder wheel 40 may be eliminated, enabling the sensor means in the force-receiving ball 90 of the driven device 70 to sense the speed and torque of the three-dimensional motion of the driven device 70 for further processing by the remote data processing module to estimate a simulation of the flying or rolling direction and distance of the force-receiving ball 90.

Further, the component parts of the ball game training apparatus may be rotated or biased relative to one another within a predetermined angle but not through 360 degrees, achieving the said same effect and function.

Further, the connection between the connection member 71 and force-receiving ball 90 of the driven device 70 in the aforesaid embodiments is a rigid connection. Alternatively, the connection between the connection member 71 and the force-receiving ball 90 can be a non-rigid or flexible connection. When steel wire rope, cord member, spring member or any of a variety of other temporarily deformable devices may be used for flexible connection between the connection member 71 and the force-receiving ball 90 so that the force-receiving ball 90 of the driven device 70 can be forced to fly or rotate freely when receiving an external force.

Except the aforesaid electronic method to transmit and read the detected data signal. Other mechanical methods may be used to transmit and read the signal produced upon each movement of the force-receiving ball 90 of the driven device 70.

As stated above, the invention provides a ball game training apparatus, which produces a thee-dimensional data indicative of the direction and amount of movement of the force-receiving ball of its driven device for reference when its driven device is driven by a player. The whole structure is highly detachable and durable in use, assuring high reliability and sensitivity.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A ball game training apparatus, comprising:

a positioning device;

a first pivot device connected to said positioning device and turnable relative to said positioning device in X-axis direction;

a second pivot device connected to said first pivot device and turnable relative to said first pivot device in Y-axis direction; and a driven device connected to said second pivot device and turnable relative to said second pivot device, said driven device comprising a force-receiving ball disposed remote from said second pivot device and strikable to move by an external force; and means for sensing the direction and amount of movement of said driven device relative to said positioning device and producing a data signal indicative of the direction and amount of movement of said driven device and transmitting the produced data signal.

2. The ball game training apparatus as claimed in claim 1, wherein said second pivot device comprises a first connection portion connected to said first pivot device in such a manner that said second pivot device is turnable relative to said first pivot device in Y-axis direction.

3. The ball game training apparatus as claimed in claim 1, wherein said second pivot device comprises a first connection portion connected to said first pivot device in such a manner that said second pivot device is turnable relative to said first pivot device in Y-axis direction and axially movable relative to said first pivot device.

4. The ball game training apparatus as claimed in claim 1, wherein said driven device further comprises a transmission member adapted for transmitting a data signal by electronic or mechanical method for reading.

5. The ball game training apparatus as claimed in claim 1, further comprising a light gate and an encoder wheel movable with one of said first pivot device, said second pivot device and said driven device relative to said light gate for inducing a data signal indicative to the direction and amount of the movement of said encoder wheel relative to said positioning device.

6. The ball game training apparatus as claimed in claim 1, further comprising spring device coupled between said driven deice and said second pivot device to buffer axial displacement of said driven device relative to said second pivot device in at least one of two reversed directions.

7. The ball game training apparatus as claimed in claim 1, wherein said force-receiving ball of said driven device is connected to said driven device by one of a rigid connection structure, a non-rigid connection structure and a flexible connection structure.

8. The ball game training apparatus as claimed in claim 1, wherein said force-receiving ball of said driven device comprises means for sensing the direction and amount of movement of said force-receiving ball relative to said positioning device and producing a data signal indicative of the direction and amount of movement of said force-receiving ball relative to said positioning device and transmitting the produced data signal by a wired or wireless transmission method.

9. The ball game training apparatus as claimed in claim 1, further comprising a light gate and an encoder wheel movable with one of said first pivot device and said driven device relative to said light gate for inducing a data signal indicative to the direction and amount of the movement of said encoder wheel relative to said positioning device.

* * * * *